United States Patent [19]

Cappelletto et al.

[11] Patent Number: 4,836,739

[45] Date of Patent: Jun. 6, 1989

[54] DEVICE FOR SUPPORTING AND TILTING VEHICLE BODIES

[76] Inventors: George C. Cappelletto, Site 3, Compartment 8, SS1 Trail, British Columbia, Canada, V1R 2Y8; Richard K. O'Genski, Box 116, Trail, British Columbia, Canada

[21] Appl. No.: 113,259

[22] Filed: Oct. 26, 1987

[51] Int. Cl.[4] ..... B66F 7/22

[52] U.S. Cl. ..... 414/678; 254/94; 269/55; 414/778

[58] Field of Search ..... 414/358, 678, 778, 779, 414/780, 781; 269/55; 254/94

[56] References Cited

U.S. PATENT DOCUMENTS

| | | | |
|---|---|---|---|
| 1,288,138 | 12/1918 | Nicoson | 414/778 X |
| 1,399,641 | 12/1921 | Mize et al. . | |
| 1,786,589 | 12/1930 | Williamson | 269/55 |
| 2,411,803 | 11/1946 | Parrott | 254/94 |
| 2,804,217 | 8/1957 | Henney | 414/678 |
| 3,674,252 | 7/1972 | Crabtree et al. | 269/55 |
| 4,192,549 | 3/1980 | Petersen | 414/678 X |
| 4,238,114 | 12/1980 | Migliorati | 254/94 X |
| 4,277,050 | 7/1981 | Mostert | 254/94 |
| 4,579,505 | 4/1986 | Lauritsen | 414/678 |
| 4,594,048 | 6/1986 | Sipla | 414/678 |

FOREIGN PATENT DOCUMENTS

| | | | |
|---|---|---|---|
| 1129868 | 9/1956 | France . | |
| 930486 | 2/1962 | United Kingdom . | |
| 2047196 | 11/1980 | United Kingdom | 254/94 |

*Primary Examiner*—Leslie J. Paperner

*Attorney, Agent, or Firm*—Limbach, Limbach & Sutton

[57] ABSTRACT

A device for tilting vehicles is disclosed which is adjustable and allows a vehicle to be manually tilted readily by an individual. The device has two identical V-shaped units. When the vehicle is upright the device rests on a central horizontal base. The vehicle can be rocked to one side or the other to rest on one of the arms of the "V" and thereby expose the underside of the vehicle. The lengths of the arms of the "V" are adjustable to adapt the device to different vehicles.

9 Claims, 6 Drawing Sheets

DEVICE FOR SUPPORTING AND TILTING VEHICLE BODIES

BACKGROUND OF THE INVENTION

The invention relates to devices for tilting a vehicle such as an automobile and supporting it in a tilted position to permit access to the underside of the vehicle for repairs and bodywork.

Normally a hydraulic lift is utilized to raise a vehicle to allow an automobile mechanic to work on it. Such lifts are expensive and therefore are only available to well-equipped service stations. Car jacks and portable ramps are used by the less-equipped mechanic. These latter devices, however, do not provide as free access to the underside of the vehicle as is desired by the mechanic.

A number of simple devices are known which allow a vehicle to be tilted on its side without the use of power assistance. For example, U.S. Pat. No. 1,399,641 issued Dec. 6, 1921 to Mize et al. illustrates an early form of automobile-tilting frame. The device has two curved rockers onto which the automobile is driven by means of ramps. The vehicle is then secured to the frame and the entire device may be tilted to expose the underside of the vehicle. Similar cradles which are attached directly to the vehicle wheel hub are shown in U.S. Pat. No. 3,674,252 issued July 4, 1972 to Crabtree et al. and U.S. Pat. No. 4,594,048 issued June 10, 1986 to Sipla. These variations use arcuate weight-bearing members.

The problem with existing vehicle-tilting devices is that they are either quite large, cumbersome and expensive to construct (Mize) or are difficult to install and tilt by hand (Crabtree and Sipla). Also, such devices typically tilt the automobile a full 90 degrees which requires that the vehicle be drained of oil and gasoline before tilting.

The present invention therefore provides a vehicle-tilting apparatus which is inexpensive to construct, easy to install and allows an individual to easily tilt the vehicle into working position by hand.

SUMMARY OF THE INVENTION

The present invention provides a vehicle-tilting device for securing to a vehicle and allowing the vehicle to be tilted and supported on its side. The device includes a V-shaped base member formed of a horizontal base element having stabilizing attachment elements and two arms joining the base element at an acute angle at either end of the base element. Adjustable arm elements slidably extend from the two arms of the base element and have secured to the end thereof clamping means for securing to the vehicle. According to one embodiment the clamping means comprise jawlike plates which are tightened to the vehicle body. In a second embodiment the clamping means comprise jaws which slide over and are secured to the wheel nuts on the vehicle wheel hub. In a further embodiment of the invention the base element may be U-shaped to allow the placement of a jack in line with the arms of the device. According to another aspect of the invention a brace may be provided between the arms of the base element for additional strength. Preferably the acute angle is about 25 degrees.

BRIEF DESCRIPTION OF THE DRAWINGS

In drawings which illustrate an embodiment of the invention.

DESCRIPTION OF A PREFERRED EMBODIMENT OF THE INVENTION

Figure 1:
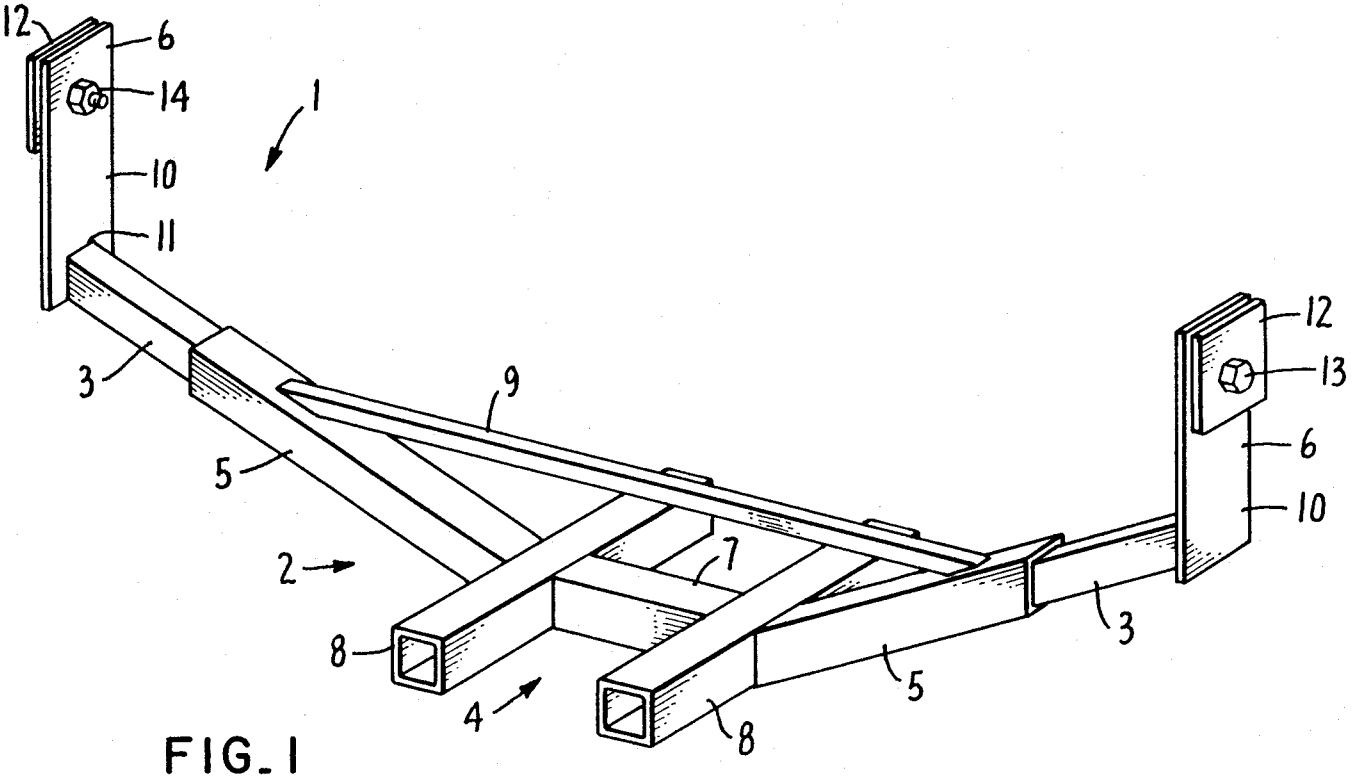
FIG. 1 is a perspective view of a first embodiment of the invention.
Figure 2:
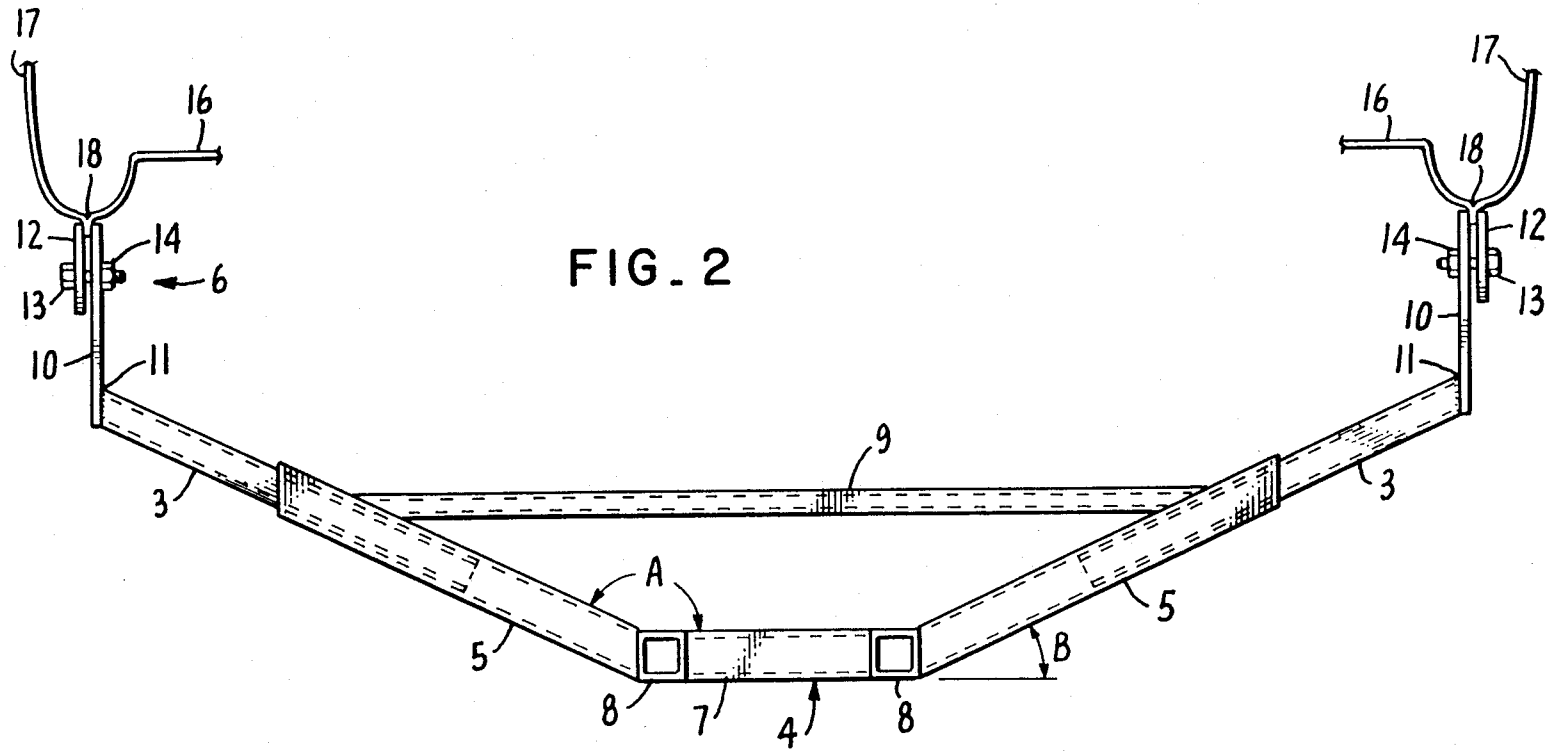
FIG. 2 is a front view of the embodiment shown in FIG. 1.
Figure 3:
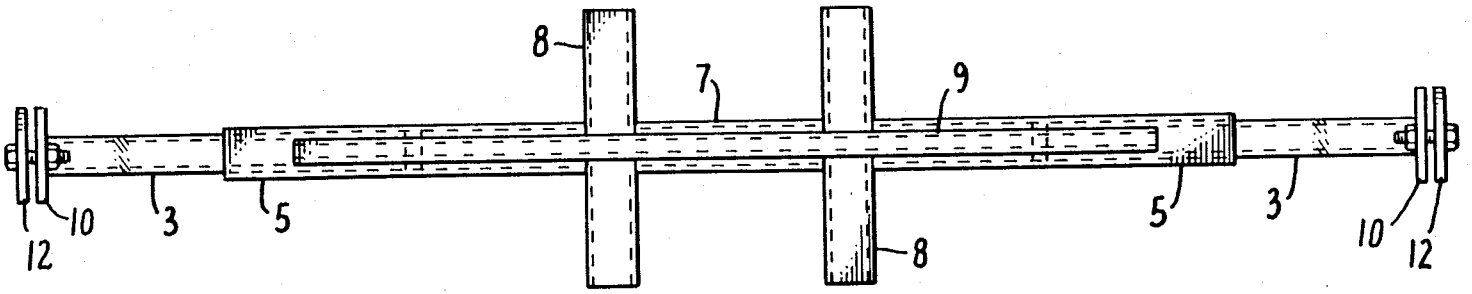
FIG. 3 is a top view of the embodiment shown in FIG. 1.

Referring to FIGS. 1 through 3, one of the vehicle-tilting devices of the invention is shown. Normally a pair of two identical such devices will be used to tilt the vehicle.

Each device, indicated by numeral 1, consists of a base element 2 and two extendible arms 3. The base element is formed of steel tubing of dimensions 2 inches by 2 inches, while the extendible arms are formed of $1\frac{1}{2}$ inch by $1\frac{1}{2}$ inch square steel tubes (also called hollow structural section). Base element 2 in turn is composed of a horizontal base element 4 and angled arms 5 which extend upwardly from base element 4 at an obtuse angle A approximately 110 to 165 degrees and preferably 155 degrees. Supplementary angle B is thus preferably about 25 degrees.

At the end of extendible arms 3 is a clamping element 6 which is described further below.

Horizontal base element 4 consists of a central piece of square tubing 7 and two cross pieces 8 of hollow square tubing welded into piece 7 and respective arms 5. Extendible arms 3 are shown as sliding freely within the hollow ends of arms 5, with the portion of extendible arms 3 in the interior of arms 5 shown in dotted outline in FIGS. 2 and 3. The additional dotted lines indicate the interior surfaces of the hollow tubing.

Figure 4:
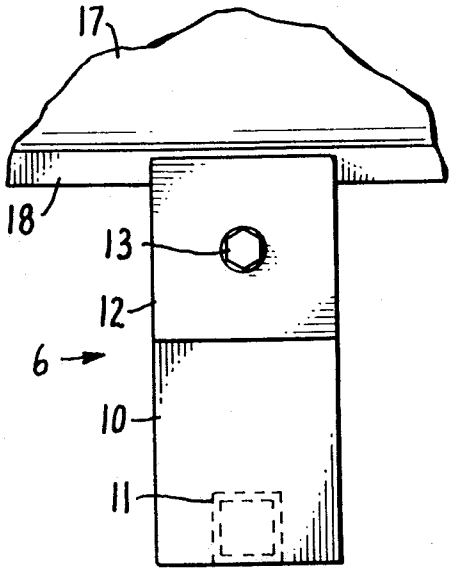
FIG. 4 is a detailed end view showing the clamping end of the invention shown in FIG. 1.

With reference to FIGS. 2 and 4, a piece of flat metal plate approximately $\frac{3}{8}$ inch thickness by 10 inches in length by 4 inches wide, indicated by numeral 10, is shown connected to extendible arm 3 by a weld 11. A second plate 12, shorter in length than plate 10 forms the second jaw of the pair or jaws of the clamp. Welded to plate 12 is a threaded bolt 13 which extends through holes in plate 12 and plate 10 and is secured and tightened by nut 14. For additional strength a piece of appropriately sized channel iron may be substituted for plate 10.

In order to install the device, the vehicle is raised on jacks. The floor of the car is indicated as 16 and the sill portion by numeral 17 of FIG. 2. One of the devices is placed under the vehicle towards one end and the second of the pair of devices is placed under the vehicle towards the other end. Extendible arms 3 are extended and clamps 6 are tightened around weld seam 18 to secure the ends of arms 3 to either side of the vehicle body. This is repeated with both devices. The jacks may then be lowered, extendible arms 3 slide slightly back into base element 2 until the vehicle rests in a stable position.

The vehicle may then be tilted to either side by simply applying some force to one side or the other of the vehicle. The vehicle will rock on square stabilizing feet 8 and an individual will be able to lay the vehicle down on either one or the other of the arms of the V-shaped device formed by arms 5 and extendible arms 3. The individual may then work on the underside of the vehicle and tilt it up again when completed.

A cross-brace 9 is used to increase the strength of the embodiment shown in FIGS. 1 through 3.

A one-piece cradle can be created from a pair of the installed devices as follows. A pair of longitudinal pieces of hollow square steel tubing 1½ inches square, of sufficient length, are slid through corresponding hollow tubes 8 of the two installed devices and are secured to the tubes 8 by bolts or screws. Wheels can then be mounted on the unified cradle as follows. First one end and then the other of the vehicle with attached cradle is jacked up. Over the outer end of each of the four tubes 8 is slid a collar having a caster or wheel mounted thereon and the collar is secured by a bolt. The vehicle is then lowered onto the four wheels and can then be easily moved without removing the tilting device and replacing the vehicle's wheels.

A second embodiment of the clamping end 6 is shown in FIGS. 5 through 8. In this embodiment a rigid pair of jaws 26 is provided to slide over the existing threaded bolts 21 of wheel hub 20 and to rest against the end of the hub extension 22. The end 25 of the jaws is angled to allow the rounded end of the hub extension to sit snugly against the jaws. The wheel nuts 27 are used to tighten the jaws against the wheel hub 20.

Figure 5:
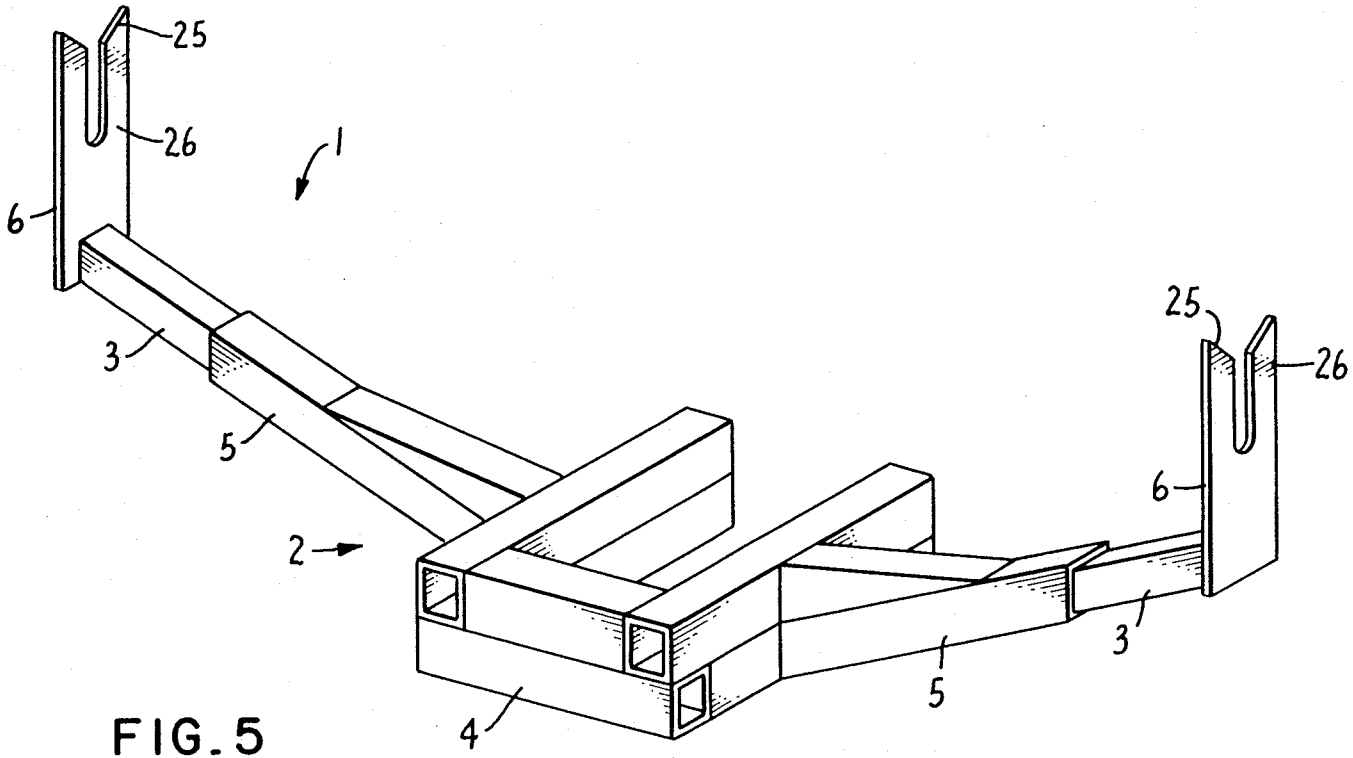
FIG. 5 is a perspective view of a second embodiment of the invention.
Figure 6:
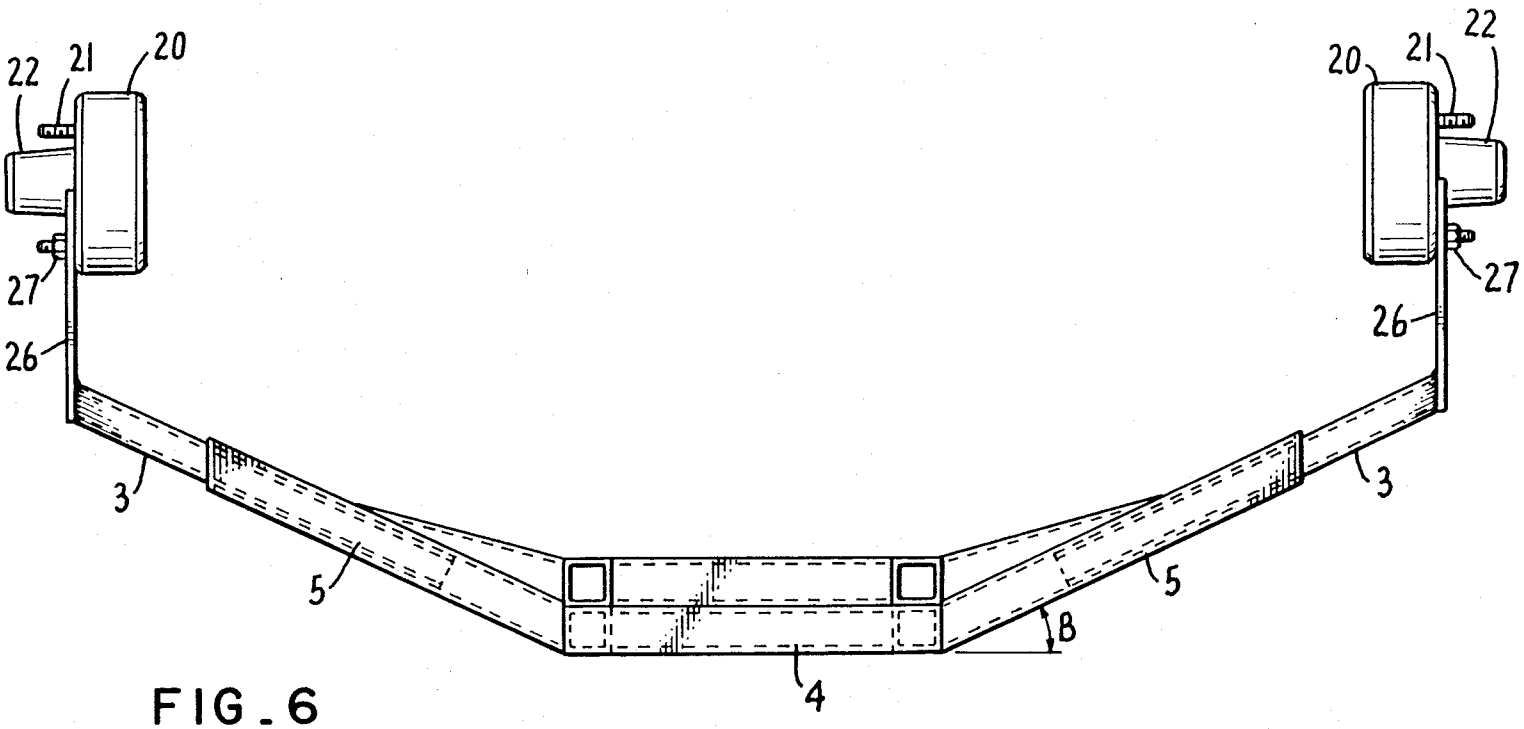
FIG. 6 is a front view of the embodiment of the invention shown in FIG. 5.
Figure 7:
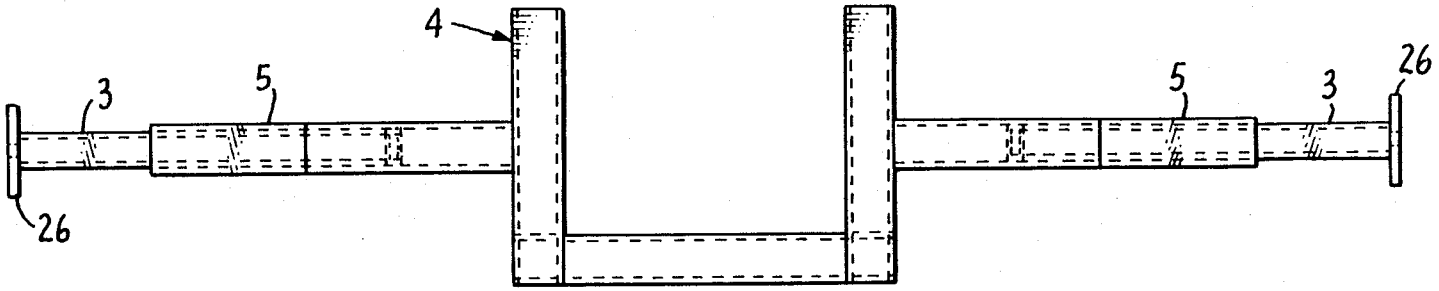
FIG. 7 is a top view of the embodiment of the invention shown in FIG. 5.
Figure 8:
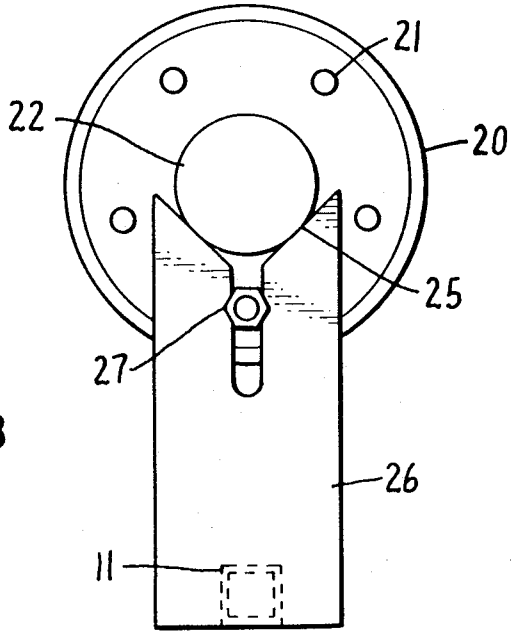
FIG. 8 is a detailed end view showing the clamping end of the embodiment of the invention shown in FIG. 5.

A further embodiment of the base element 2 is also shown in FIGS. 5 through 7. In this embodiment the base element is U-shaped to allow the placement of a jack directly in line with the arms of the tilting device. As shown from the front view in FIG. 6, this embodiment has a double thickness of steel tubing on the base element for additional strength instead of cross brace 9. Since arms 3 are the same for either of the two variations of clamping ends 6 either embodiment of clamping end 6 can be used with either embodiment of the base element 2. However the embodiment of base element 2 shown in FIG. 5 is best suited for combination with jaws 26 as in this way the jack can be placed directly under the rear axle of the vehicle for raising and lowering.

Rather than utilizing one straight element forming an angle of about 25 degrees with the horizontal, arm 5 could be formed of two or more straight elements joined at an angle proportionately less than 25 degrees. For example, a first straight portion could join the horizontal element at 12.5 degrees, with a second straight element joining the first at 12.5 degrees.

While various alterations of the above-described structure will be apparent to those skilled in the art, the scope of the invention is to be construed as defined in the accompanying claims.

The embodiments of the invention in which an exclusive property or privilege is claimed are defined as follows:

1. A vehicle-tilting device for securing to a vehicle and allowing the vehicle to be tilted and supported in the tilted position, comprising:

(a) a horizontal base member;

(b) two hollow arms secured at each end of said base member and forming an acute angle with the horizontal, each having an open end;

(c) an arm extension element associated with each of said arms and adapted to be slidably supported in and extended from said open ends of said arms; and (d) means secured to the end of each arm extension element for securing to a vehicle body.

2. The vehicle-tilting device of claim 1 further comprising horizontal extended stabilizing bars secured adjacent either end of said base element, running transversely to said base element and extending outwardly on either side of said base element.

3. The vehicle-tilting device of claim 1 wherein said securing means comprises two opposed faces and means for drawing said opposed faces together into gripping contact.

4. The vehicle-tilting device of claim 1 wherein said securing means comprises a plate having an aperture for receiving a bolt extending from the wheel hub of said vehicle and an upper surface shaped to receive and support the central hub extension of said wheel hub.

5. The vehicle-tilting device of claim 1 further comprising a brace element extending horizontally between said hollow arms and secured at each end thereof to one of said arms.

6. The vehicle-tilting device of claim 1 wherein said acute angle is between 10 and 60 degrees.

7. The vehicle-tilting device of claim 1 wherein said acute angle is between 10 and 45 degrees.

8. The vehicle tilting device of claim 1 wherein said acute angle is approximately 25 degrees.

9. A vehicle-tilting device for securing to a vehicle and allowing the vehicle to be tilted and supported in the tilted position, comprising two of the vehicle tilting devices of claim 1 joined in a fixed spaced relationship by one or more rigid longitudinal elements.

* * * * *